US007976231B2

(12) United States Patent
Addison et al.

(10) Patent No.: US 7,976,231 B2
(45) Date of Patent: Jul. 12, 2011

(54) METHOD AND APPARATUS FOR ADJUSTING A GAP IN A PRINTER

(75) Inventors: Danny Hugh Addison, Durham, NC (US); Stacy Leigh Arrington, Raleigh, NC (US); Richard Hunter Harris, Raleigh, NC (US); Robert Andrew Myers, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 818 days.

(21) Appl. No.: 11/956,015

(22) Filed: Dec. 13, 2007

(65) Prior Publication Data

US 2009/0154977 A1 Jun. 18, 2009

(51) Int. Cl.
*B41J 25/308* (2006.01)

(52) U.S. Cl. ..... 400/59; 400/55; 400/355

(58) Field of Classification Search ..... 400/55, 400/56, 59, 354.3, 355; 347/8
See application file for complete search history.

(56) References Cited

U.S. PATENT DOCUMENTS

| | | | | |
|---|---|---|---|---|
| 3,935,936 | A | 2/1976 | Wilczewski | |
| 4,023,662 | A | 5/1977 | Perucca | |
| 4,381,896 | A | 5/1983 | Shiurila | |
| 4,493,566 | A * | 1/1985 | McMahon et al. | 400/59 |
| 4,787,759 | A | 11/1988 | Geis et al. | |
| 4,906,115 | A | 3/1990 | Bischof | |
| 5,000,590 | A | 3/1991 | Einem | |
| 6,394,568 | B1 | 5/2002 | Menendez | |
| 6,450,612 | B2 | 9/2002 | Igarashi et al. | |
| 6,736,557 | B2 | 5/2004 | DeVore et al. | |
| 6,899,474 | B2 | 5/2005 | Uchida et al. | |
| 7,470,072 | B2 | 12/2008 | Furihata | |

FOREIGN PATENT DOCUMENTS

| | | | |
|---|---|---|---|
| CN | 2663145 | | 12/2004 |
| DE | 3636572 | A1 * | 5/1988 |
| JP | 02127071 | A * | 5/1990 |
| JP | 02208082 | A * | 8/1990 |
| JP | 05262006 | A * | 10/1993 |
| JP | 07156501 | A * | 6/1995 |
| JP | 08072359 | A * | 3/1996 |
| JP | 2003072055 | A * | 3/2003 |

* cited by examiner

*Primary Examiner* — Daniel J Colilla
(74) *Attorney, Agent, or Firm* — Yee & Associates, P.C.; Thomas E. Tyson

(57) ABSTRACT

The illustrative embodiments described herein provide an apparatus and method for adjusting a gap in a printer. The apparatus includes the printer that has a print head transport shaft. The print head is slidably coupled to the transport shaft. The apparatus includes an adjusting plate comprising a groove. The adjusting plate is located at a first side of the printer. The adjusting plate is slidably coupled to the transport shaft via the groove. Moving the adjusting plate along a first axis changes a first position of the print head on the first side of the printer to form the gap. The first axis is perpendicular to the transport shaft. The apparatus also includes a spring. The spring biases the adjusting plate such that the groove is biased toward the transport shaft.

20 Claims, 6 Drawing Sheets

METHOD AND APPARATUS FOR ADJUSTING A GAP IN A PRINTER

BACKGROUND OF THE INVENTION

1. Field of the Invention

The present invention relates generally to a method and apparatus for adjusting a gap. More particularly, the present invention relates to a method and apparatus for adjusting a gap in a printer.

2. Description of the Related Art

Many types of printers, such as impact printers, contain a print head used to print on printable media, such as paper. The print head of an impact printer contains one or more printing elements that strike, either directly or indirectly, the printable media to produce the printed document. In one example, the printer element may strike the printable media through an ink ribbon. In this example, the printer element that strikes the printable media may be one of a plurality of needles that are driven by one or more electric solenoids or coils. Also, impact print heads may be able to move from one side of the impact printer to the other along a transport shaft, thereby allowing the impact print head to strike at different portions along the width of the printable media.

Examples of impact printers include dot matrix printers and character printers. Point of sale printers are another example of an impact printer. Point of sale printers may require the use of impact print heads because users of point of sale printers may use multi-part forms.

In order to print correctly, impact printers require tight control of the gap between the print head and a platen. Printable media passes through the gap, which is defined by the print head and the platen. In one example, maximum tolerance for error in the distance of the gap may be held to +/−0.0008 inches or +/−0.02 millimeters. Also, the gap may need to be controlled at all print positions as the print head travels across the printable media. The correct distance for the gap may depend on the thickness of the printable media onto which the print head prints. Failure to correctly adjust the gap can result in misalignment or jamming of the printable media and premature failure of the print head.

Achieving a tight gap tolerance may present considerable challenges. For example, a high level of skill, such as that provided only by skilled technicians, may be required on a manufacturing line during assembly of the printer. A high level of skill may also be required in repairing the printer, such as when the print head must be replaced. However, requiring high levels of skill to adjust the gap makes gap adjustment inaccessible to a layperson, and requires a printer user to waste both time and money obtaining technicians having sufficient levels of skill in printer technology.

In existing designs, the gap can vary depending on the amount of force used to position the print head during adjustment. This force may be provided by a user in a non-uniform fashion, thereby leading to intolerable error in adjusting the gap distance. In existing designs, the gap can also vary depending on how consistently the user performing the adjustment can feel when the correct gap has been achieved. These existing designs also fail to minimize clearances between components of the printer. Such clearances may lead, individually or cumulatively, to error in the gap distance.

BRIEF SUMMARY OF THE INVENTION

The illustrative embodiments described herein provide an apparatus and method for adjusting a gap in a printer. The apparatus includes the printer that has a print head and a transport shaft. The print head is slidably coupled to the transport shaft. The apparatus includes an adjusting plate comprising a groove. The adjusting plate is located at a first side of the printer. The adjusting plate is slidably coupled to the transport shaft via the groove. Moving the adjusting plate along a first axis changes a first position of the print head on the first side of the printer to form the gap. The first axis is perpendicular to the transport shaft. The apparatus also includes a spring. The spring biases the adjusting plate such that the groove is biased toward the transport shaft.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
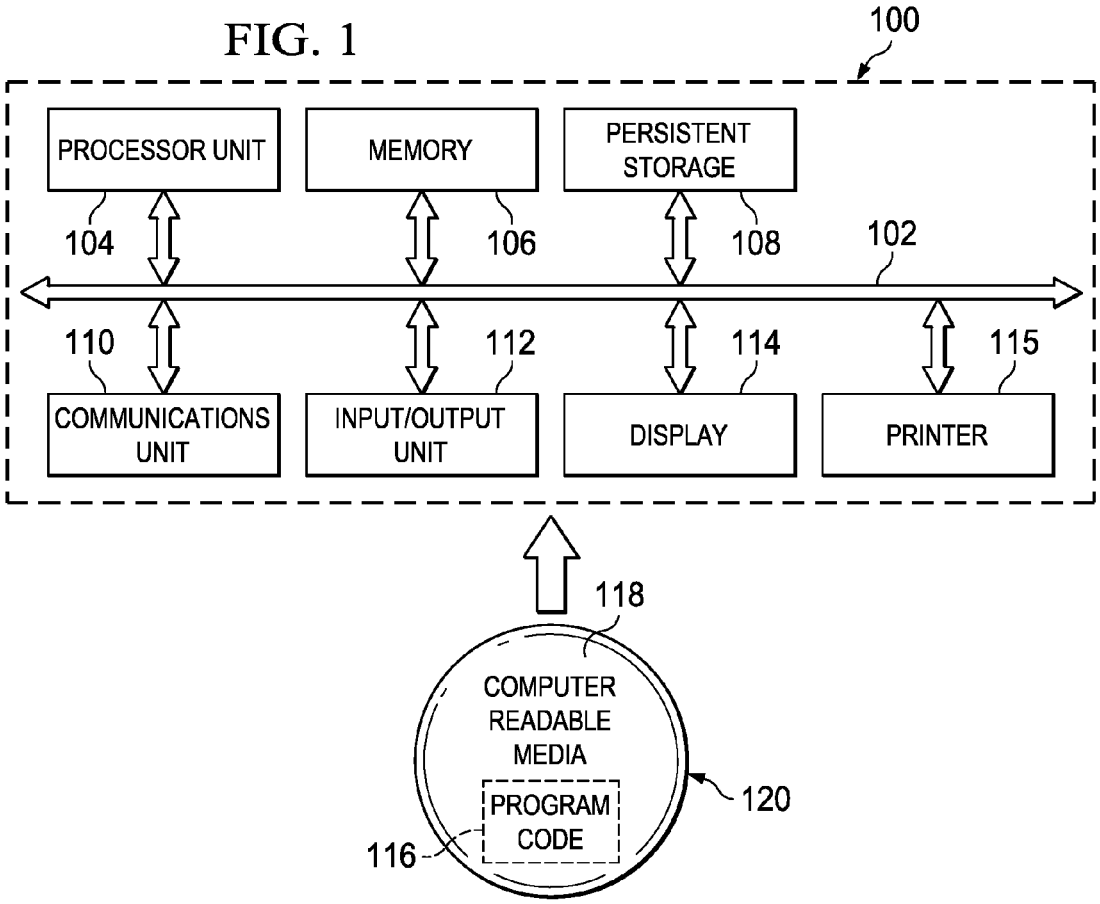
FIG. 1 is a block diagram of a data processing system in accordance with an illustrative embodiment of the present invention.

Turning now to FIG. 1, a block diagram of a data processing system is depicted in accordance with an illustrative embodiment of the present invention. In this illustrative example, data processing system 100 includes communications fabric 102, which provides communications between processor unit 104, memory 106, persistent storage 108, communications unit 110, input/output (I/O) unit 112, display 114, and printer 115.

Processor unit 104 serves to execute instructions for software that may be loaded into memory 106. Processor unit 104 may be a set of one or more processors or may be a multiprocessor core, depending on the particular implementation. Further, processor unit 104 may be implemented using one or more heterogeneous processor systems in which a main processor is present with secondary processors on a single chip. As another illustrative example, processor unit 104 may be a symmetric multi-processor system containing multiple processors of the same type.

Memory 106, in these examples, may be, for example, a random access memory. Persistent storage 108 may take various forms depending on the particular implementation. For example, persistent storage 108 may contain one or more components or devices. For example, persistent storage 108 may be a hard drive, a flash memory, a rewritable optical disk, a rewritable magnetic tape, or some combination of the above. The media used by persistent storage 108 also may be removable. For example, a removable hard drive may be used for persistent storage 108.

Communications unit 110, in these examples, provides for communications with other data processing systems or devices. In these examples, communications unit 110 is a network interface card. Communications unit 110 may provide communications through the use of either or both physical and wireless communications links.

Input/output unit 112 allows for input and output of data with other devices that may be connected to data processing system 100. For example, input/output unit 112 may provide a connection for user input through a keyboard and mouse. Further, input/output unit 112 may send output to printer 115. Display 114 provides a mechanism to display information to a user.

Instructions for the operating system and applications or programs are located on persistent storage 108. These instructions may be loaded into memory 106 for execution by processor unit 104. The processes of the different embodiments may be performed by processor unit 104 using computer implemented instructions, which may be located in a memory, such as memory 106. These instructions are referred to as, program code, computer usable program code, or computer readable program code that may be read and executed by a processor in processor unit 104. The program code in the different embodiments may be embodied on different physical or tangible computer readable media, such as memory 106 or persistent storage 108. In one embodiment, the program code may be executed to perform processes, such as printing a receipt on printer 115 for transactions that occurs at a point of sale.

Printer 115 may be used to print any type of document. In one example, printer 115 is an impact printer that uses an impact printer head. Instructions may be sent to printer 115 on communications fabric 102 to provide printer 115 with a set of parameters relating to the printing of one or more documents. These parameters may contain, for example, data that should be printed on a receipt to be printed by printer 115 at a point of sale. In addition, because printer 115 is compatible with a variety of different operating systems, such as Microsoft® Windows or Unix, instructions may be sent to printer 115 regardless of the operating system executing on data processing system 100. Microsoft and Windows are trademarks of Microsoft Corporation in the United States, other countries, or both. Printer 115 may be connected to one or more of the other components of the FIG. 1 via a direction connection, such as a bus, or over a network, such as the Internet.

Program code 116 is located in a functional form on computer readable media 118 and may be loaded onto or transferred to data processing system 100 for execution by processor unit 104. Program code 116 and computer readable media 118 form computer program product 120 in these examples.

The different components illustrated for data processing system 100 are not meant to provide architectural limitations to the manner in which different embodiments may be implemented. The different illustrative embodiments may be implemented in a data processing system including components in addition to or in place of those illustrated for data processing system 100. Other components shown in FIG. 1 can be varied from the illustrative examples shown.

For example, a bus system may be used to implement communications fabric 102 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 106 or a cache such as found in an interface and memory controller hub that may be present in communications fabric 102.

Figure 2:
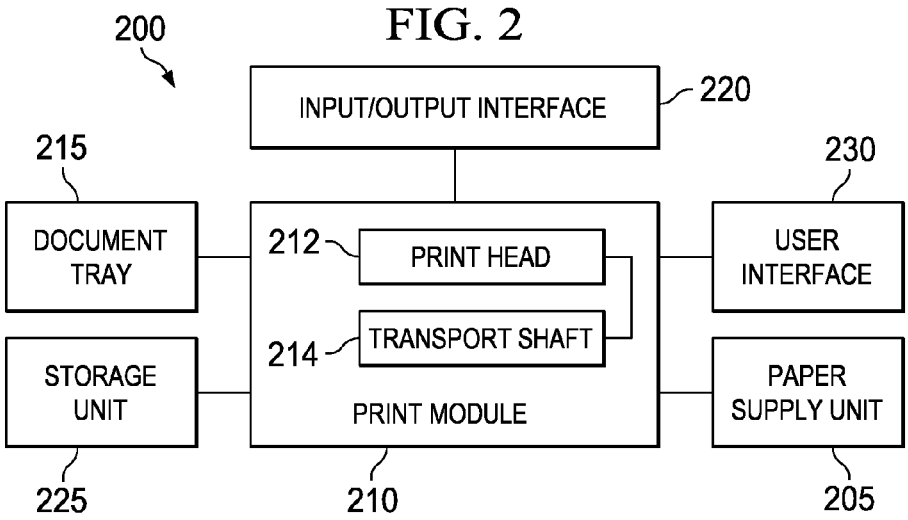
FIG. 2 is a block diagram of a printer in which the illustrative embodiments may be implemented.

Turning now to FIG. 2, a block diagram of a printer is depicted in which the illustrative embodiments may be implemented. Printer 200 is a non-limiting example of printer 115 in FIG. 1. In this illustrative example, printer 200 may be any type of printer, such as, for example, a thermal printer, toner-based printer, liquid inkjet printer, solid ink printer, dye-sublimation printer, inkless printer, impact printer, daisy wheel printer, dot-matrix printer, line printer, or a pen-based plotter. Printer 200 may be used in any type of application, such as a point of sale printer, an office printer, or a home-use printer. A point of sale printer is sometimes referred to as a fiscal printer.

Printer 200 includes paper supply unit 205. Paper supply unit 205 holds printable media that is used by printer 200 to print documents. The printable media in paper supply unit 205 may take a variety of forms, such as a roll of printable media or a stack of pre-cut sheets of printable media. The printable media may be made of any material that is capable of being printed on by printer 200, such as paper or heat-sensitive material.

Printer 200 includes print module 210. Print module 210 is the hardware in printer 200 that prints on the printer media to create a document. For example, print module 210 may apply ink to a paper in paper supply unit 205 using a toner. In another example, print module 210 uses thermal-printing techniques by selectively heating regions of portions of a roll of heat-sensitive paper in paper supply unit 205. In another example, print module 210 applies ink to one or more sheets of pre-cut paper in paper supply unit 205.

Print module 210 includes print head 212. Print head 212 is a component of printer 200 that is used to apply print onto printable media. Print head 212 may apply print onto printable media using a variety of techniques. For example, print head 212 may be an impact print head that laterally travels across printable media along transport shaft 214. In this example, components print head 212 strike, either directly or indirectly, the printable media to produce the printed document. Print head 212 may be slidably coupled to transport shaft 214.

Documents created in print module 210 exit printer 200 at document tray 215. The documents at document tray 215 may be retrieved by a user or by another device for processing.

Printer 200 includes input/output interface 220. Input/output interface 220 is an interface between printer 200 and any external devices. Input/output interface 220 may be, for example, one or more ports into which a detachable storage device may be received. Input/output interface 220 may also be a connection port into which a computer, point of sale device, cash register, or any other data processing system is connected. For example, printer 200 may be connected to one or more of the components of printer 200 via input/output interface 220.

Data received at input/output interface 220 may be sent to other components of printer 200 and used in the creation of documents. For example, transaction information may be sent to printer 200 at input/output interface 220 from a point of sale device so that a receipt may be printed using a roll of heat-sensitive paper in paper supply unit 205. This data may be buffered or otherwise stored in storage unit 225. Storage unit 225 may be random access memory, a hard drive, or detachment forms of memory.

Printer 200 also includes user interface 230. User interface 230 includes any controls that allow a user to adjust settings for printer 200. For example, user interface 230 may include controls that allow a user to select a type of paper in paper supply unit 205 to be used to create a document. User interface 230 may also include a control, such as a button or knob, which opens the cover of printer 200. The cover may enclose the paper in paper supply unit 205. Alternatively, user interface 230 may be displayed on a graphical user interface of data processing system that is connected to printer 200 via input/output interface 220.

Figure 3:
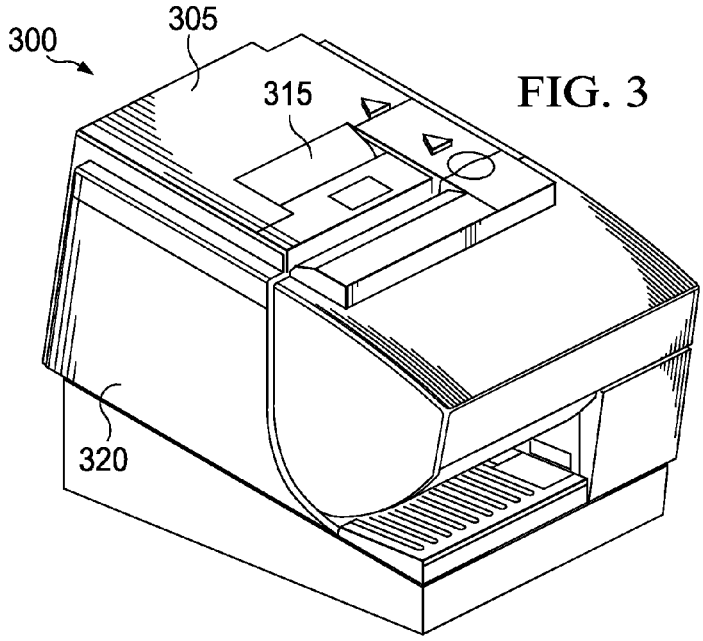
FIG. 3 is an illustration of a printer in which a gap may be adjusted in accordance with an illustrative embodiment.

Turning now to FIG. 3, an illustration of a printer in which a gap may be adjusted is depicted in accordance with an illustrative embodiment. Specifically, FIG. 3 shows printer 300, which is a non-limiting example of printer 115 in FIG. 1 and printer 200 in FIG. 2.

In one non-limiting example, printer 300 is a point of sale printer. Printer 300 includes cover 305. Cover 305 is coupled to printer 300 and covers an area of printer 300 that holds the printable media, such as a roll of paper.

Cover 305 may be coupled to printer 300 in a variety of ways. For example, cover 305 may rest on printer 300 without the aid of any connections at all. In another example, one side of cover 305 may be pivotably coupled to printer 300 such that any particular side of cover 305 may be lifted, thereby revealing the contents of printer 300 concealed by cover 305.

Printer 300 also includes document tray 315. Document tray 315 is a non-limiting example of document tray 215 in FIG. 2. For example, transaction documents, such as receipts, that are printed using printer 300 may exit printer 300 and come to rest at document tray 315. A user may then retrieve these receipts at document tray 315.

Printer 300 also includes frame 320. Frame 320 is a component of printer 300 that encloses, fully or partially, other components of printer 300. For example, frame 320 may include exterior top, bottom, and sidewalls of printer 300. In this example, frame 320 may be made of any material, such as plastic or metal.

The illustrative embodiments described herein provide an apparatus and method for adjusting a gap in a printer. The printer includes a print head and a transport shaft. A gap is any distance in the printer at least partially defined by the position of the print head. A transport shaft is an object that supports the print head, and along which the print head may move.

In one embodiment, the printer includes a platen. A platen is a component of the printer that supports the printable media to facilitate the application of print onto the printable media, such as a substantially flat surface against which an impact print head may strike. In this embodiment, the gap may be a distance between the platen and the print head. In another embodiment, the first axis is perpendicular to the platen.

The print head is slidably coupled to the transport shaft. As used herein, the term "coupled" includes coupling via a separate object. For example, the print head may be coupled to the transport shaft if both the cover and the base are coupled to a third object, such as a carriage. The term "coupled" also includes "directly coupled," in which case the two objects touch each other in some way. The term "coupled" also encompasses two or more components that are continuous with one another by virtue of each of the components being formed from the same piece of material.

The apparatus includes an adjusting plate comprising a groove. The groove is any indentation in the surface or shape of the adjusting plate. In one embodiment, the groove is a tapered groove having a wide end and a narrower, tapered end.

The adjusting plate is located at a first side of the printer. The first side may be any side of the printer, such as left, right, front, or back. In one embodiment in which the print head moves from left to right and right to left along the transport shaft, the adjusting plate may be located on either the left side or right side of the printer.

The adjusting plate is slidably coupled to the transport shaft via the groove. In one example, moving the adjusting plate along a first axis changes a first position of the print head on the first side of the printer to form the gap. The first axis is perpendicular to the transport shaft.

In one embodiment, the print head is capable of sliding relative to the transport shaft along a second axis. In this embodiment, the second axis is parallel to the transport shaft. Also, in this embodiment, the transport shaft may include a fitting groove. The fitting groove may restrain or prevent movement of the transport shaft along the second axis relative to the adjusting plate.

The apparatus also includes a spring. The spring is any compressible band capable of exerting a force. The spring biases the adjusting plate such that the groove is biased toward the transport shaft. A "bias" is any exertion of force. In one embodiment, the spring biases the adjusting plate toward the platen in a direction parallel to or along the first axis.

In another embodiment, the apparatus also includes an anchoring point. The anchoring point is any point on the adjusting plate at which the adjusting plate may be pivotably coupled relative to the frame of the printer. In one example, the anchoring point is a removable screw that may couple the adjusting plate to the frame. In one embodiment, the spring may rotationally bias the adjusting plate around an axis defined by the anchoring point such that the groove is biased toward the transport shaft.

In the embodiment in which the groove is a tapered groove, the spring may bias the tapered groove toward the transport shaft such that contact between the tapered groove and the transport shaft restrains or prevents movement of the transport shaft in a direction parallel to the first axis. In this embodiment, the contact between the tapered groove and the transport shaft may occur via the fitting groove in the transport shaft.

In another embodiment, the apparatus also includes a second adjusting plate. In this embodiment, the second adjusting plate is located on a second side of the printer. The second side may be on the opposite side of the printer as the first side. For example, the first side may be the left side of the printer and the second side may be the right side of the printer.

The second adjusting plate may include a trapezoidal hole and a flanging portion. The flanging portion is a protruding portion of the second adjusting plate. The flanging portion may be bent relative to the rest of the second adjusting plate. The trapezoidal hole may include a tapered end. The second adjusting plate is coupled to the transport shaft via the trapezoidal hole. In one example, moving the second adjusting plate parallel to the first axis changes a second position of the print head on the second side of the printer to form the gap on the second side of the printer.

In one embodiment, the apparatus includes an adjustment pin, such as a screw, that may be coupled to the flanging portion of the second adjusting plate. In this embodiment, moving or tightening the adjustment pin may bias the tapered end of the trapezoidal hole toward the transport shaft such that movement of the transport shaft along the first axis is restricted.

The apparatus may also include a second spring that is coupled to the second adjusting plate. The second spring may bias the second adjusting plate toward a platen in a direction parallel to the first axis.

Figure 4:
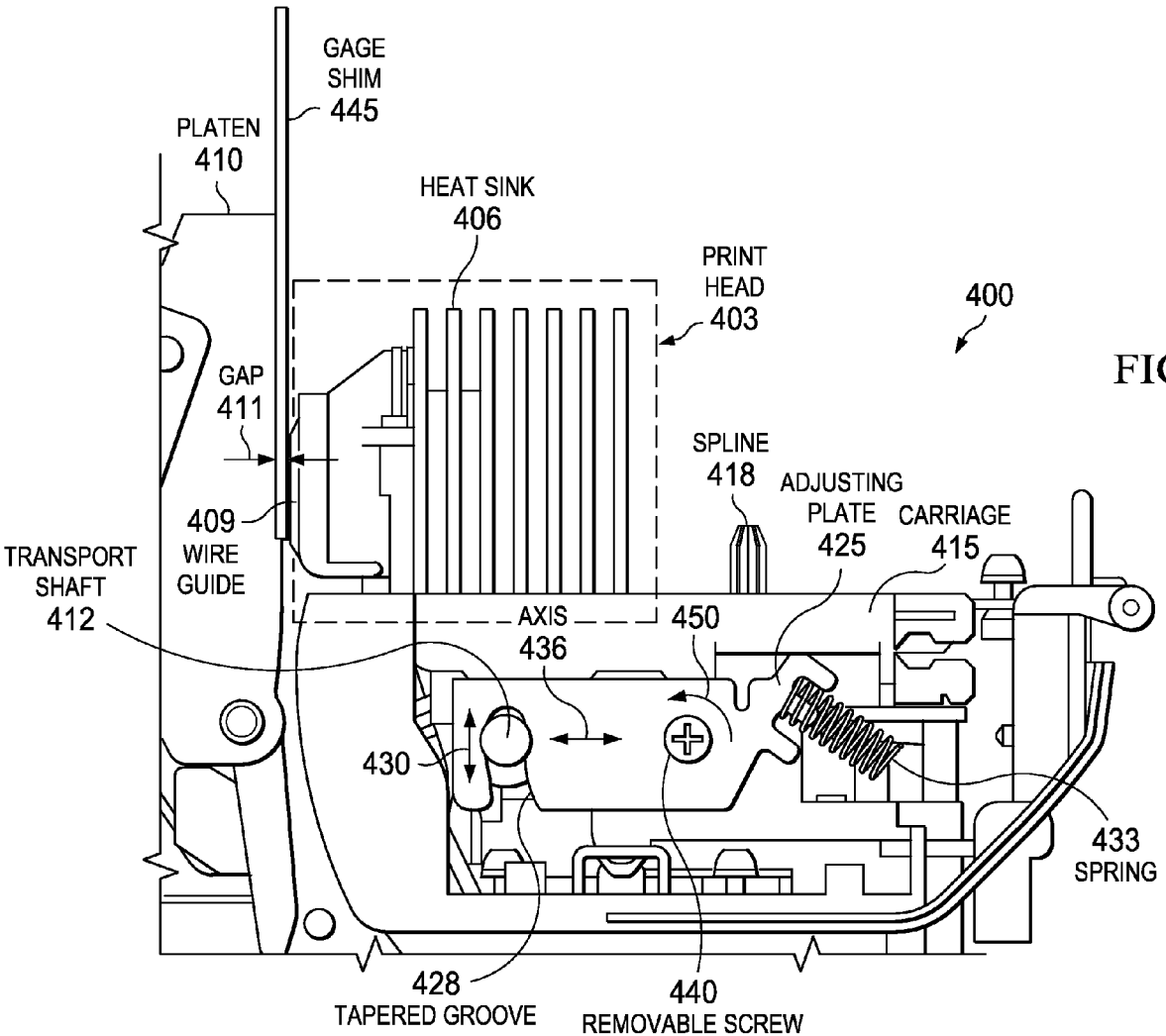
FIG. 4 is a perspective view of a printer for adjusting a gap in accordance with an illustrative embodiment.

Turning now to FIG. 4, a perspective view of a printer for adjusting a gap is depicted in accordance with an illustrative embodiment. Specifically, FIG. 4 shows printer 400, which is a non-limiting example of printer 115 in FIG. 1, printer 200 in FIG. 2, and printer 300 in FIG. 3.

Printer 400 includes print head 403. Print head 403 may print on printable media using any of a variety of techniques depending on the type of printer in which print head 403 is contained. In the non-limiting example shown in FIG. 4, printer 400 is an impact printer, and print head 403 is an impact print head that applies print to printable media by striking, either directly or indirectly, the printable media. Print head 403 includes heat sink 406 and wire guide 409. Heat sink 406 dissipates thermal energy created by the inefficient conversion of electrical energy to mechanical energy necessary to cause the print wires to directly or indirectly strike the print media at high frequency. Wire guide 409 constrains each print wire in a way that allows it to easily slide toward the printable media and also precisely controls the location on the print media where the print wire strikes.

Printer 400 also includes platen 410. In one embodiment, printable media, such as paper, passes through gap 411, which is the distance between platen 410 and print head 403. Platen 410 supports the printable media as the printable media passes through gap 411. For example, platen 410 may provide a surface against which an impact print head, such as print head 403, may strike as the printable media passes through gap 411. Platen 410 may be made of any material, such as plastic, metal, or hardened rubber.

Printer 400 also includes transport shaft 412, which is shown in FIG. 4 as having a circular cross-section. Transport shaft 412 is a cylindrical object that supports print head 403, and along which print head 403 may move. Although transport shaft 412 is shown as having a circular cross-section, transport shaft 412 may have any cross-sectional shape, such as elliptical, square, or polygonal.

In one embodiment, print head 403 is slidably coupled to transport shaft 412. In this embodiment, print head 403 may move back and forth along the length of transport shaft 412, thereby allowing print head 403 to apply print at various portions along the width of the printable media.

As shown in the embodiment in FIG. 4, print head 403 is slidably coupled to transport shaft 412 via carriage 415. Carriage 415 connects print head 403 to transport shaft 412, and also supports a ribbon between platen 410 and print head 403 that is not shown in FIG. 4. The ribbon cartridge, which is discussed in greater detail in FIG. 9, rests atop a printer frame, which may be an extension of platen 410. In this position, spline 418 is inserted in the spindle of the ribbon cartridge. As will be shown in FIG. 9, the ribbon that protrudes from the ribbon cartridge extends across gap 411.

Printer 400 includes adjusting plate 425. Adjusting plate 425 may be composed of any material, such as metal, plastic, wood, or hardened rubber. Adjusting plate 425 is located at one side of printer 400, adjacent to an end of transport shaft 412.

Although one adjusting plate 425 is shown in printer 400, printer 400 may contain any number of adjusting plates. In one non-limiting example, printer 400 contains two adjusting plates that are each located at opposite ends of transport shaft 412.

Adjusting plates other than adjusting plate 425 in printer 400 may be structurally and operationally similar to adjusting plate 425. However, adjusting plates other than adjusting plate 425 may be structurally and operationally different from adjusting plate 425. A non-limiting example of one such adjusting plate is shown with respect to FIGS. 7-9 below.

Adjusting plate 425 includes tapered groove 428. One end of tapered groove 428, shown in FIG. 4 as the bottom end, is wider than the opposite end of tapered groove 428, shown in FIG. 4 as the top end. Although tapered groove 428 is shown as being tapered, tapered groove 428 may also be non-tapered. Tapered groove 428 may also be a slot or hole by which transport shaft 412 is coupled to adjusting plate 425.

Adjusting plate 425 is slidably coupled to transport shaft 412 via tapered groove in a direction indicated by arrow 430. However, as will be shown below, spring 433 provides a force on adjusting plate 425 that keeps transport shaft 412 in a secured, non-clearance position in tapered groove 428.

In one embodiment, due to the coupling between adjusting plate 425 and print head 403, a movement of adjusting plate 425 along axis 436 changes the position of print head 403 on the side of printer 400 at which adjusting plate 425 is located. Thus, gap 411 is changed on the side of printer 400 at which adjusting plate 425 is located as adjusting plate 425 is moved. In this embodiment, axis 436 is perpendicular to transport shaft 412.

Printer 400 also includes spring 433. Spring 433 may be any compressible band, such as a helical spring, conical spring, spiral spring, torsion spring, or gas spring. Spring 433 may be composed of any material, including metal, plastic, or rubber. Spring 433 may also be capable of exerting any desired expansion force, and may be replaced by other springs having different expansion forces or physical characteristics.

Spring 433 is shown to have an orientation that forms an angle with axis 436, thereby giving spring 433 a diagonal orientation. In this orientation, the force exerted by spring 433 has at least two components. One component of this force acts along axis 436, such that spring 433 biases or urges adjusting plate 425 toward platen 410. The second force component acts on adjusting plate 425 to keep transport shaft 412 in a secured, non-clearance position in tapered groove 428.

In one embodiment, adjusting plate 425 is free to move along axis 436 using the force from spring 433 when removable screw 440 is removed or loosened from adjusting plate 425. In one example, removable screw 440 anchors adjusting plate 425 to the frame of printer 400 at a particular anchoring point. In this example, adjusting plate 425 may be free to pivot around the anchoring point defined by removable screw 440. In other embodiments, removable screw 440 may be an anchoring pin, nail, clip, or any other device that may be inserted into adjusting plate 425.

In one example, removable screw 440 may be inserted into the frame of printer 400 and adjusting plate 425, thereby securing adjusting plate 425, and therefore print head 403, at a particular position. For example, once gap 411 has been properly adjusted by moving adjusting plate 425, removable screw 440 may be inserted into adjusting plate 425 once adjusting plate 425 has been properly positioned such that gap 411 has been properly adjusted. One method for determining the proper position for adjusting plate 425 utilizes gage shim 445. This method will be discussed further below with respect to the present figure.

As discussed above, the force that positions adjusting plate 425 along axis 436 may be caused by spring 433. However, in one example, this force may originate from any source, such as a user, motor, or gravity.

Another component of the force caused by spring 433 may be a rotational force in the direction indicated by arrow 450.

In particular, spring 433 may rotationally bias adjusting plate 425 around an axis defined by removable screw 440 such that tapered groove 428 is biased toward transport shaft 412. This moment of force indicated by arrow 450 and originating from spring 433 causes contact between tapered groove 428 and transport shaft 412 such that the movement of transport shaft 412 is restrained or prevented in the direction parallel to axis 436. Such movement of transport shaft 412 is restrained or prevented because clearance between transport shaft 412 and adjusting plate 425 is eliminated due to the direct contact between transport shaft 412 and adjusting plate 425. By restraining or preventing transport shaft 412, and therefore print head 403, from moving in a direction parallel to axis 436, the introduction of error into the distance of gap 411 is lessened.

As discussed above, print head 403 may slide relative to transport shaft 412 along a second axis. This second axis is parallel to transport shaft 412. In one embodiment, transport shaft 412 has a fitting groove at the point at which transport shaft 412 is coupled to tapered groove 428. The fitting groove may restrain or prevent the movement of transport shaft 412 along the second axis relative to adjusting plate 425. Additional details regarding the fitting groove are provided in FIG. 6 below.

In one embodiment, gap 411 may be adjusted using gage shim 445. Gage shim 445 may have a thickness that is approximately equal to the desired distance of gap 411. In this embodiment, gage shim 445 may be inserted between platen 410 and print head 403 while removable screw 440 is loose relative to adjusting plate 425. Because removable screw 440 is loose from adjusting plate 425, adjusting plate 425 is free to move along axis 436. Thus, spring 433 may bias adjusting plate 425 toward platen 410 such that print head 403 presses against gage shim 445.

In one example, removable screw 440 is capable of securably coupling adjusting plate 425 and a frame of printer 400. In this example, the frame of printer 400 may have one or more slots through which transport shaft 412 may pass or terminate. The one or more slots may allow transport shaft 412 and adjusting plate 425 to move together along axis 436 such that gap 411 may be varied. In this example, removable screw 440 may pass through a slot in the frame of printer 400 and couple to adjusting plate 425. Hence, a tightening of removable screw 440 clamps the frame of printer 400 between the head of removable screw 440 and adjusting plate 425. A non-limiting example of the frame of printer 400 is discussed in greater detail in FIG. 5 below.

In response to print head 403 pressing against gage shim 445, adjusting plate 425 may be coupled to the frame of printer 400, such as by inserting or tightening removable screw 440 through the printer frame and into adjusting plate 425. Thus, gap 411, at the side of printer 400 at which adjusting plate 425 is located, may be defined by the thickness of gage shim 445.

As removable screw 440 is inserted or tightened into adjusting plate 425, thereby securing adjusting plate 425 along axis 436, spring 433 may rotationally bias adjusting plate 425 around removable screw 440 such that tapered groove 428 is biased toward transport shaft 412. In this way, clearance between tapered groove 428 and transport shaft 412 is eliminated. Thus, the movement of transport shaft 412, to which print head 403 is slidably coupled, along axis 436 is prevented and less error is introduced into the distance of gap 411 once gage shim 445 is removed.

The same method described above for using gage shim 445 to adjust gap 411 may be repeated for the opposite side of printer 400. Hence, gap 411 may be properly adjusted along the length of the printable media that passes through gap 411. In one embodiment, described in FIGS. 7-9, the adjusting plate on the opposite side of printer 400, than the side illustrated in FIG. 4, may have a different structure and operate different than adjusting plate 425.

Figure 5:
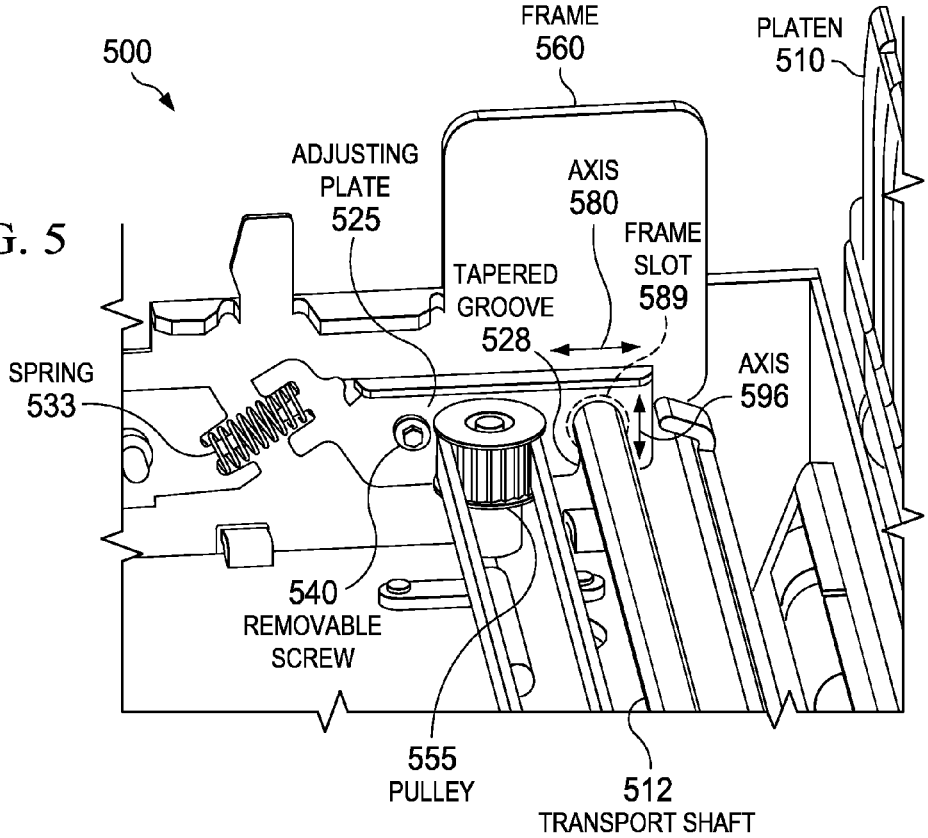
FIG. 5 is a perspective view of a printer for adjusting a gap in accordance with an illustrative embodiment.

Turning now to FIG. 5, a perspective view of a printer for adjusting a gap is depicted in accordance with an illustrative embodiment. Specifically, FIG. 5 shows printer 500, which is a non-limiting example of printer 400 in FIG. 4.

FIG. 5 shows a different side of adjusting plate 525 than that shown for adjusting plate 425 in FIG. 4. The print head and carriage for printer 500 are not shown in FIG. 5. However, pulley 555, which moves a print head back and forth along transport shaft 512, is shown in FIG. 5.

Printer 500 includes frame 560. Adjusting plate 525 is anchored to frame 560 via removable screw 540. Because adjusting plate 525 is anchored to frame 560 via removable screw 540, spring 533 is prevented from moving adjusting plate 525 along an axis that is perpendicular to transport shaft 512. After inserting removable screw 540, spring 533 exerts a rotational moment around an axis defined by removable screw 540, thereby biasing tapered groove 528 towards transport shaft 512. Thus, movement of transport shaft 512 in a direction towards or away from platen 510 is restrained or prevented due to the elimination of clearance between adjusting plate 525 and transport shaft 512. This eliminated clearance may be maintained by anchoring adjusting plate 525 to frame 560 via removable screw 540.

In one example, removable screw 540 may be tightened to varying degrees of tightness. In this example, removable screw 540 may be tightened such that the movement of adjusting plate 525 along an axis perpendicular to transport shaft 512, as well as the rotational movement of adjusting plate 525 about an axis defined by removable screw 540, is restrained or prevented.

In one embodiment, frame 560 includes frame slot 589 into which transport shaft 512 may be inserted. Frame slot 589 may have any shape, such as an ellipse. Frame slot 589 may constrain movement of transport shaft 512 along axis 596, but also allow transport shaft 512 to move along an axis parallel to axis 580. In one embodiment, frame slot 589 may allow transport shaft 512 to move approximately one millimeter along an axis parallel to axis 580.

In one embodiment, spring 533 is also coupled to frame 560. In this embodiment, frame 560 provides a sturdy base from which spring 533 may exert a force on adjusting plate 525.

Figure 6:
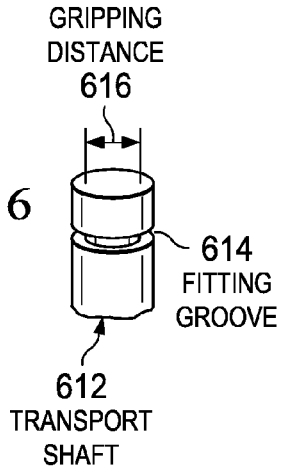
FIG. 6 is a transport shaft of a printer for adjusting a gap in accordance with an illustrative embodiment.

Turning now to FIG. 6, a transport shaft of a printer for adjusting a gap is depicted in accordance with an illustrative embodiment. Specifically, FIG. 6 shows transport shaft 612, which is a non-limiting example of transport shaft 412 in FIG. 4 and transport shaft 512 in FIG. 5.

Transport shaft 612 may be coupled to a groove in an adjusting plate via fitting groove 614. Coupling, including slidably coupling, transport shaft 612 to a groove in an adjusting plate via fitting groove 614 restrains or prevents the movement of transport shaft 612 along an axis that is parallel to the length of transport shaft 612.

Fitting groove 614 may include one or more separate grooves in transport shaft 612. For example, fitting groove 614 may be one continuous groove around the circumference of transport shaft 612. In another example, fitting groove 614 may be two or more straight grooves in transport shaft 612 that fully or partially defines a rectangular cross-sectional shape of transport shaft 612 at the point at which fitting groove 614 occurs. Alternately, the fitting groove could be replaced by a hole or cavity in transport shaft and a tapered, pin-like profile on the adjusting plate.

Gripping distance 616, which is defined by the depth of fitting groove 614, may be any desirable distance. Gripping distance 616 determines the point along a tapered groove, such as tapered groove 428 in FIG. 4, at which clearance between transport shaft 612 and the adjusting plate is eliminated.

Figure 7:
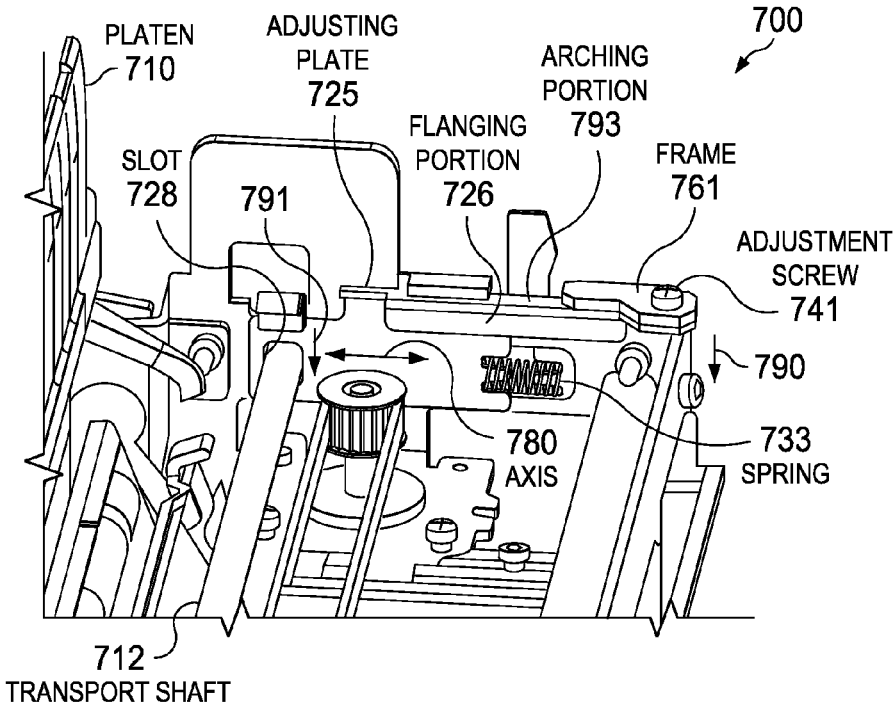
FIG. 7 is a perspective view of a printer for adjusting a gap in accordance with an illustrative embodiment.

Turning now to FIG. 7, a perspective view of a printer for adjusting a gap is depicted in accordance with an illustrative embodiment. Specifically, FIG. 7 shows printer 700, which is a non-limiting example of printer 115 in FIG. 1, printer 200 in FIG. 2, printer 300 in FIG. 3, and printer 400 in FIG. 4. Printer 700 contains a print head and carriage that are similar to print head 403 and carriage 415, respectively, in FIG. 4. However, the print head and carriage are not shown in FIG. 7 so that the structure and operation of adjusting plate 725 may be more easily depicted.

Printer 700 includes adjusting plate 725. In one embodiment, adjusting plate 725 is located at an opposite end of the same transport shaft as adjusting plate 425 in FIG. 4. Thus, in this embodiment, the adjusting plate at each end of the transport shaft for printer 700 have different structures and may operate differently. Such a difference in the two adjusting plates in printer 700 may be necessary due to the difference in the structure at each side of printer 700. For example, the presence of a removable screw, such as removable screw 440 in FIG. 4, that is insertable through the side of the printer frame may not be possible on the side of the printer at which adjusting plate 725 is present.

In an alternate embodiment, each side of printer 700 has an adjusting plate that is similar in structure and operation to adjusting plate 725. For example, each end of transport shaft 712 may be coupled to a separate adjusting plate that each resembles adjusting plate 725.

Adjusting plate 725 includes slot 728. In the illustrative embodiment shown in FIG. 7, slot 728 is a trapezoidal hole that has a tapered end. Thus, as shown in FIG. 7, the top, tapered end of slot 728 is narrower than the bottom end of slot 728, thereby forming a trapezoidal shape. In alternate embodiments, slot 728 may have any shape, such as a circle, ellipse, triangle, or polygon.

In one embodiment, adjusting plate 725 is coupled to transport shaft 712 via slot 728. In this embodiment, adjusting plate 725 may be coupled to transport shaft 712 via slot 728.

In one example, moving adjusting plate 725 along axis 780 changes the position of the print head in printer 700 to form the gap, which is defined by the distance between the print head and platen 710. In particular, the movement of adjusting plate 725 along axis 780 may form the gap on the particular side of printer 700 at which adjusting plate 725 is located. As shown in FIG. 7, axis 780 is substantially perpendicular to transport shaft 712.

The movement of adjusting plate 725 along axis 780 may be assisted by spring 733, which is coupled to adjusting plate 725. In particular, spring 733 may bias adjusting plate 725 toward platen 710 along axis 780. The structure of spring 733 may be similar to spring 433 in FIG. 4.

Adjusting plate 725 includes flanging portion 726. Flanging portion 726 is a protruding portion of adjusting plate 725 that may be coupled to the frame 761 of printer 700. In one embodiment, flanging portion 726 is bent downwards in the direction indicated by arrow 790, making flanging portion 726 non-parallel with axis 780.

Printer 700 includes adjustment screw 741. Frame 761 is coupled to flanging portion 726 via adjustment screw 741. Adjustment screw 741 may also be a pin, clip, rod, or other device capable of coupling print components.

Tightening adjustment screw 741 pulls flanging portion 726 in an upwards direction toward frame 761. Arching portion 793 reinforces the rigidity of adjusting plate 725 to ensure proper operation and minimize the chances that adjusting plate 725 will break or otherwise fail. Because flanging portion 726 is bent relative to adjusting plate 725, a corresponding downward force is exerted on adjusting plate 725 at slot 728 in the direction indicated by arrow 791. In this way, the tightening of adjustment screw 741 biases the tapered end of slot 728 toward transport shaft 712 such that the movement of transport shaft 712 along axis 780 is restrained or prevented.

In one embodiment, the gap between platen 710 and the print head of printer 700 may be adjusted using a gage shim. In this embodiment, a gage shim may be inserted between platen 710 and the print head of printer 700 while adjustment screw 741 is removed or loosened. Because adjustment screw 741 is removed or loosened, adjusting plate 725 is free to move along axis 780. Thus, spring 733 may bias adjusting plate 725 toward platen 710 such that the print head presses against the gage shim.

In response to the print head pressing against the gage shim, flanging portion 726 of adjusting plate 725 may be coupled to frame 761, such as my tightening or inserting adjustment screw 741 though frame 761 and flanging portion 726. Thus, the gap, at the side of printer 700 at which adjusting plate 725 is located, may be defined by the thickness of the gage shim.

Because adjustment screw 741 has been tightened or inserted, thereby securing adjusting plate 725 along axis 780, a downward force is exerted on adjusting plate 725 at slot 728 in the direction indicated by arrow 791, thereby restraining, or preventing, the movement of transport shaft 712 along axis 780. The gage shim may then be removed.

Figure 8:
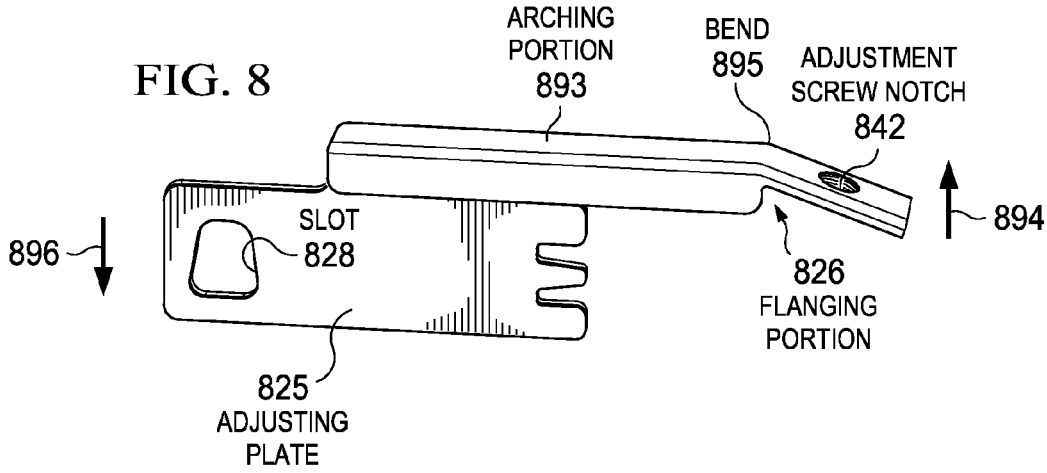
FIG. 8 is a perspective view of an adjusting plate in accordance with an illustrative embodiment.

Turning now to FIG. 8, a perspective view of an adjusting plate is depicted in accordance with an illustrative embodiment. Specifically, FIG. 8 shows adjusting plate 825, which is a non-limiting example of adjusting plate 725 in FIG. 7.

Adjusting plate 825 includes slot 828, by which adjusting plate 825 may be coupled to a transport shaft, such as transport shaft 712 in FIG. 7. Adjusting plate 825 also includes flanging portion 826. Flanging portion 826 is bent relative to the remainder of adjusting plate 825 at bend 895. An adjustment screw may be inserted into flanging portion 826 via adjustment screw notch 842.

An upward force exerted on flanging portion 826, as indicated by arrow 894, causes a downward force on adjusting plate at slot 828, as indicated by arrow 896. Arching portion 893 provides structurally resiliency for adjusting plate 825 as various forces are being exerted on adjusting plate 825.

Figure 9:
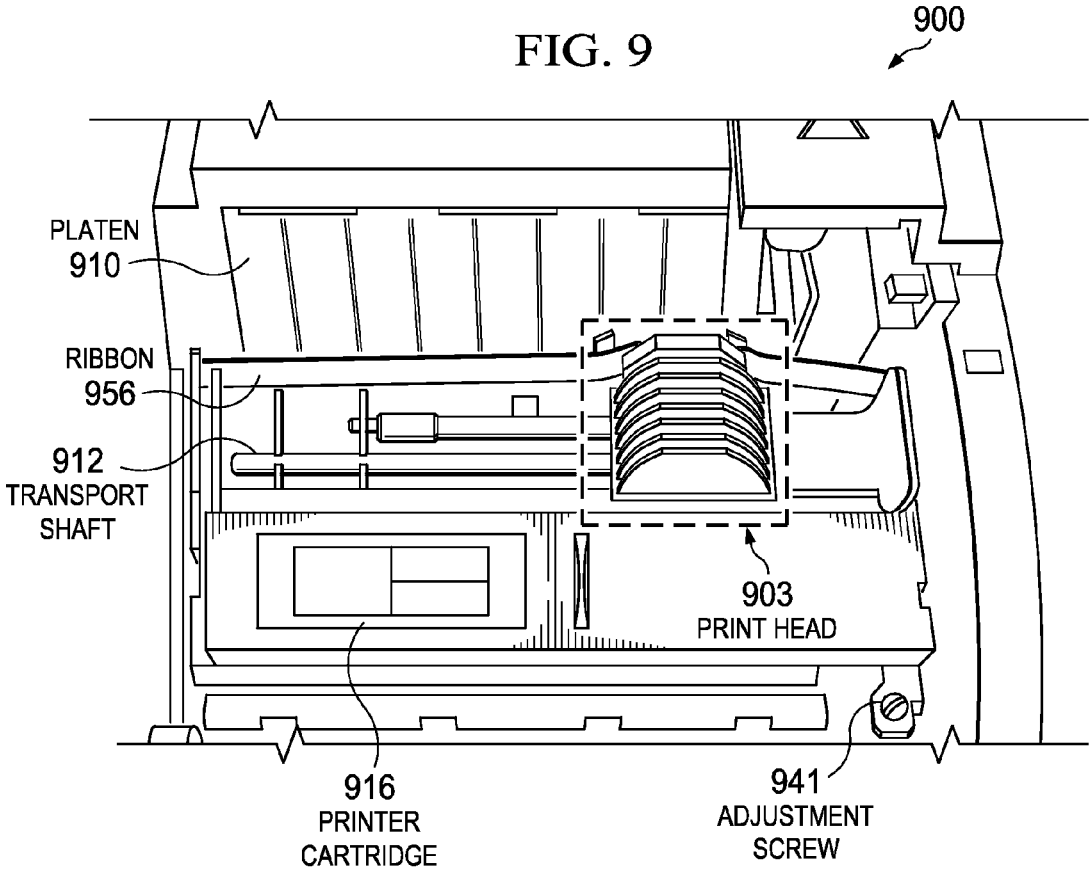
FIG. 9 is a perspective view of a printer for adjusting a gap in accordance with an illustrative embodiment.

Turning now to FIG. 9, a perspective view of a printer for adjusting a gap is depicted in accordance with an illustrative embodiment. Specifically, FIG. 9 shows printer 900, which is a non-limiting example of printer 700 in FIG. 7.

Printer 900 includes print head 903, which is capable of slidably moving back and forth along transport shaft 912. Elements within print head 903, such as needles, strike through ribbon 956 to apply print to the printable media. Ribbon 956 is part of printer cartridge 916. The printable media is supported by platen 910.

Adjustment screw 941 is a non-limiting example of adjustment screw 741 in FIG. 7. When adjustment screw 941 is removed or loose, an adjusting plate on the side of printer 900 at which adjustment screw 941 is located may be moved in a direction substantially perpendicular to transport shaft 912.

In response to inserting or tightening adjustment screw 941, the adjusting plate to which adjustment screw 941 is coupled is secured along the axis that is substantially perpendicular to transport shaft 912. Also, as described in FIGS. 7 and 8, in response to inserting or tightening adjustment screw 941, transport shaft 912 also becomes secure along the axis that is substantially perpendicular to transport shaft 912 such that the error in setting the distance of the gap between platen 910 and print head 903 is reduced or eliminated.

The illustrative embodiments described above are not limited to being implemented in a printer. The illustrative embodiments may be implemented in any device that has a gap between two components that may need to be adjusted. Non-limiting examples of such devices include a currency accepter, a fax machine, a laminator, or process equipment that separates or screens parts based on a precise part dimension.

Thus, in one embodiment, the transport shaft may be any support member that is coupled directly or indirectly to a gap-defining member. The gap is defined by a position of the gap-defining member. For example, the gap-defining member may be one wall or roller defining the gap through which a bill is passed through a bill accepter.

This illustrative embodiment also includes an adjusting plate that comprises a groove. The adjusting plate is slidably coupled to the support member via the groove. Moving the adjusting plate changes the position of the gap-defining member to form the gap. For example, the adjusting plate may be moved toward and away from the gap. As a result, the position of the gap-defining member is moved toward and away from the space defining the gap, which changes the size of the gap.

This illustrative embodiment also includes a set of flexible bands, such as a spring. The flexible band biases the adjusting plate such that the groove is biased toward the gap-defining member. The adjusting plate described in FIGS. 7-9 may be similarly adapted to be implemented in devices other than a printer.

Figure 10:
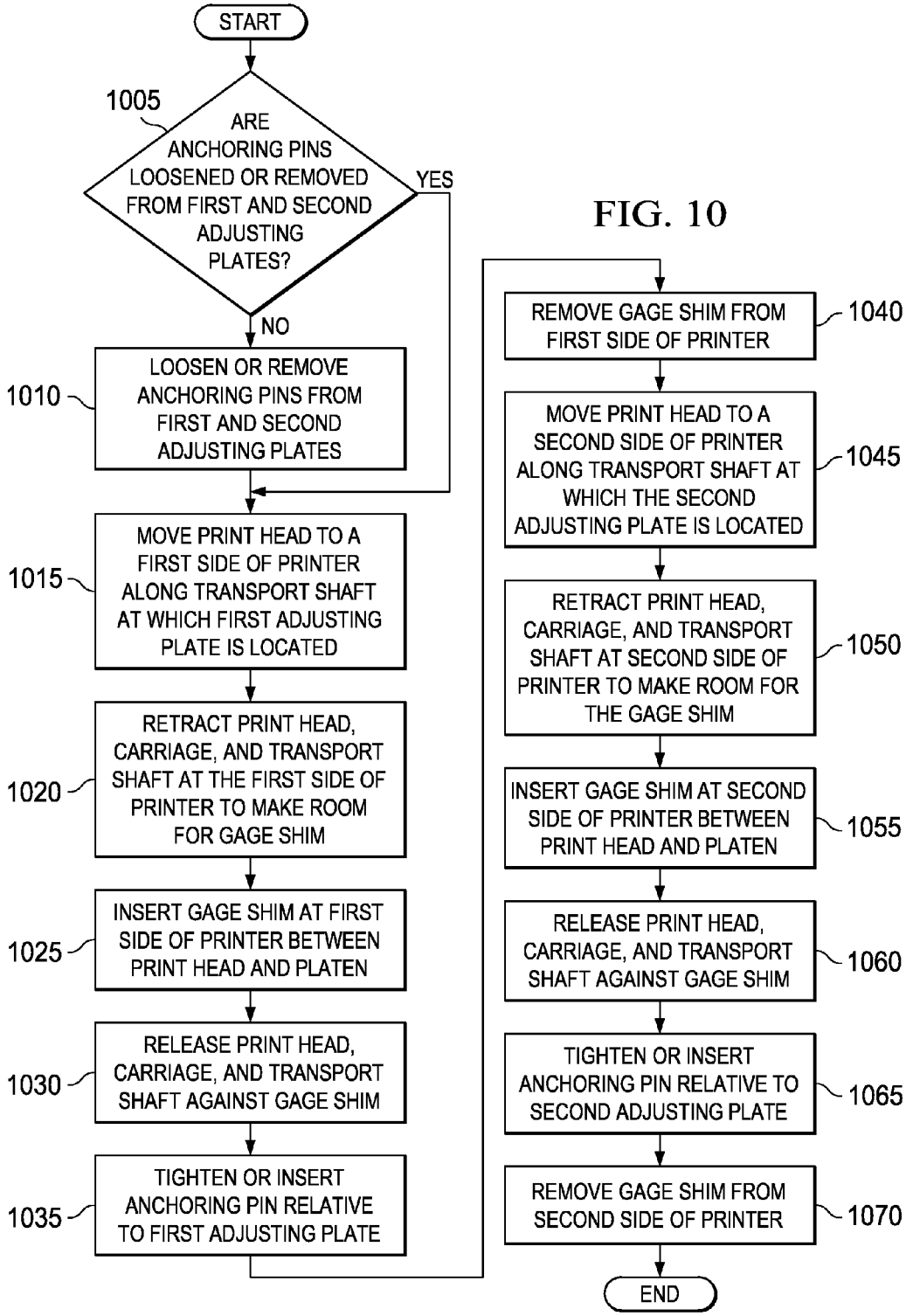
FIG. 10 is a flowchart illustrating a process for adjusting a gap in accordance with an illustrative embodiment.

Turning now to FIG. 10, a flowchart illustrating a process for adjusting a gap is depicted in accordance with an illustrative embodiment. The process illustrated in FIG. 10 may be implemented by a user in conjunction with the cooperating components of an adjusting plate as illustratively described in preceding figures.

The process begins by determining whether the anchoring pins are loosened or removed from the first and second adjusting plates (step 1005). If the process determines that the anchoring pins are not loosened or removed from the first and second adjusting plates, the process loosens or removes the anchoring pins relative to the first and second adjusting plates (step 1010).

If the process determines that the anchoring pins are loosened or removed from the first and second adjusting plates, the process moves the print head to a first side of the printer, along the transport shaft, at which the first adjusting plate is located (step 1015). The process then retracts the print head, carriage, and transport shaft at the first side of the printer to make room for a gage shim (step 1020).

The process inserts the gage shim at the first side of the printer between the print head and a platen of the printer (step 1025). The process releases the print head, carriage, and transport shaft against the gage shim (step 1030). The process tightens or inserts the anchoring pin at the first side of the printer relative to the first adjusting plate (step 1035). The process then removes the gage shim from the first side of the printer (step 1040).

The process then moves the print head to a second side of the printer, along the transport shaft, at which the second adjusting plate is located (step 1045). The process retracts the print head, carriage, and transport shaft at the second side of the printer to make room for the gage shim (step 1050). The process inserts the gage shim at the second side of the printer between the print head and the platen (step 1055). The process releases the print head, carriage, and transport shaft against the gage shim (step 1060). The process tightens or inserts the anchoring pin at the second side of the printer relative to the second adjusting plate (step 1065). The process removes the gage shim from the second side of the printer (step 1070). The process then terminates.

The flowcharts and block diagrams in the different depicted embodiments illustrate the architecture, functionality, and operation of some possible implementations of apparatus and methods. In this regard, each block in the flowchart or block diagrams may represent a module, segment, or portion of code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

The illustrative embodiments described herein provide an apparatus and method for adjusting a gap in a printer. The printer includes a print head and a transport shaft.

In one embodiment, the printer includes a platen. In this embodiment, the gap may be a distance between the platen and the print head. The print head is slidably coupled to the transport shaft.

The apparatus includes an adjusting plate comprising a groove. In one embodiment, the groove is a tapered groove having a wide end and a narrower, tapered end.

The adjusting plate is located at a first side of the printer. The adjusting plate is slidably coupled to the transport shaft via the groove. In one example, moving the adjusting plate parallel to a first axis changes a first position of the print head on the first side of the printer to form the gap. The first axis is approximately perpendicular to the transport shaft.

In one embodiment, the print head is capable of sliding relative to the transport shaft along a second axis. In this embodiment, the second axis is parallel to the transport shaft. Also, in this embodiment, the transport shaft may include a fitting groove. The fitting groove may restrain or prevent movement of the transport shaft along the second axis relative to the adjusting plate.

The apparatus also includes a spring. The spring biases the adjusting plate such that the groove is biased toward the transport shaft. In one embodiment, the spring biases the adjusting plate toward the platen in a direction parallel to the first axis.

In another embodiment, the apparatus also includes an anchoring point. In one example, the anchoring point is a removable screw that may couple the adjusting plate to the frame. In one embodiment, the spring may rotationally bias the adjusting plate around an axis defined by the anchoring point such that the groove is biased toward the transport shaft.

In the embodiment in which the groove is a tapered groove, the spring may bias the tapered groove toward the transport shaft such that contact between the tapered groove and the transport shaft restrains or prevents movement of the transport shaft in a direction parallel to the first axis. In this embodiment, the contact between the tapered groove and the transport shaft may occur via the fitting groove in the transport shaft.

In another embodiment, the apparatus also includes a second adjusting plate. In this embodiment, the second adjusting plate is located on a second side of the printer. The second side may be on the opposite side of the printer as the first side. For example, the first side may be the left side of the printer and the second side may be the right side of the printer.

The second adjusting plate may include a trapezoidal hole and a flanging portion. The flanging portion may be bent relative to the rest of the second adjusting plate. The trapezoidal hole may include a tapered end. The second adjusting plate is coupled to the transport shaft via the trapezoidal hole. In one example, moving the second adjusting plate parallel to the first axis changes a second position of the print head on the second side of the printer to form the gap on the second side of the printer.

In one embodiment, the apparatus includes an adjustment pin, such as a screw, that may be coupled to the flanging portion of the second adjusting plate. In this embodiment, moving or tightening the adjustment pin may bias the tapered end of the trapezoidal hole toward the transport shaft such that movement of the transport shaft along the first axis is restricted.

The apparatus may also include a second spring that is coupled to the second adjusting plate. The second spring may bias the second adjusting plate toward a platen in a direction parallel to the first axis.

The illustrated embodiments include a system that provides for the consistent adjustment of a print head in a manner that requires minimal skill levels from the person adjusting the gap. Using only a minimal skill level, a consistent gap adjustment, as well as minimal clearance between adjusting plate and the transport shaft, is achieved. The consistent gap adjustment and minimal skill are facilitated by the uniform force provided by one or more springs that exert force on one or more adjusting plates.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus comprising:

a printer having a print head and a transport shaft, wherein the print head is slidably coupled to the transport shaft;

an adjusting plate having a groove, wherein the adjusting plate is located at a first side of the printer, wherein the adjusting plate is slidably coupled to the transport shaft via the groove, and wherein moving the adjusting plate along a first axis changes a first position of the print head on the first side of the printer to form a gap, wherein the first axis is perpendicular to the transport shaft; and a spring biasing the adjusting plate such that a first end of the groove is biased toward the transport shaft; and an anchoring point, wherein the spring rotationally biases the adjusting plate around an axis defined by the anchoring point such that the groove is biased toward the transport shaft.

2. The apparatus of claim 1, wherein the printer further comprises:

a platen, and wherein the gap is a distance between the platen and the print head.

3. The apparatus of claim 2, wherein the spring biases the adjusting plate toward the platen along the first axis.

4. The apparatus of claim 2, wherein the first axis is perpendicular to the platen.

5. The apparatus of claim 1, wherein the anchoring point is a removable screw.

6. The apparatus of claim 1, wherein the groove is a tapered groove, wherein the spring biases the first end of the tapered groove toward the transport shaft such that contact between the tapered groove and the transport shaft restrains movement of the transport shaft along the first axis, and wherein the first end is a closed end.

7. The apparatus of claim 1, wherein the printer further comprises:

a frame, wherein the spring is coupled to the frame.

8. The apparatus of claim 1, further comprises:

a carriage, wherein the print head is slidably coupled to the transport shaft via the carriage.

9. The apparatus of claim 1, comprising:

a second adjusting plate, wherein the second adjusting plate is located on a second side of the printer, wherein the second adjusting plate comprises a trapezoidal hole and a flanging portion, wherein the trapezoidal hole has a tapered end, wherein the second adjusting plate is coupled to the transport shaft via the trapezoidal hole, wherein moving the second adjusting plate along the first axis changes a second position of the print head on the second side of the printer to form the gap;

an adjustment pin, wherein the adjustment pin is coupled to the flanging portion, and wherein moving the adjustment pin biases the tapered end of the trapezoidal hole toward the transport shaft such that movement of the transport shaft along the first axis is restricted; and a second spring, wherein the second spring is coupled to the second adjusting plate, and wherein the second spring biases the second adjusting plate toward a platen along the first axis.

10. The apparatus of claim 9, wherein the adjustment pin is an adjustment screw.

11. An apparatus comprising:

a printer having a print head and a transport shaft, wherein the print head is slidably coupled to the transport shaft, wherein the print head is capable of sliding relative to the transport shaft along a second axis, wherein the second axis is parallel to the transport shaft, and wherein the transport shaft comprises:

a fitting groove, wherein the fitting groove restrains movement of the transport shaft along the second axis relative to the adjusting plate;

an adjusting plate having a groove, wherein the adjusting plate is located at a first side of the printer, wherein the adjusting plate is slidably coupled to the transport shaft via the groove, and wherein moving the adjusting plate along a first axis changes a first position of the print head on the first side of the printer to form a gap, wherein the first axis is perpendicular to the transport shaft; and a spring biasing the adjusting plate such that an end of the groove is biased toward the transport shaft.

12. The apparatus of claim 11, wherein the fitting groove prevents the movement of the transport shaft along the second axis relative to the adjusting plate.

13. An apparatus comprising:

a printer having a print head and a transport shaft, wherein the print head is slidably coupled to the transport shaft;

an adjusting plate having a flanging portion and a slot having a tapered end, wherein the adjusting plate is coupled to the transport shaft via the slot, wherein a movement of the adjusting plate along a first axis changes a position of the print head to form a gap, wherein the first axis is perpendicular to the transport shaft, wherein the flanging portion is bent, further comprising:

an adjustment pin, wherein the adjustment pin is coupled to the flanging portion, wherein a tightening of the adjustment pin biases the tapered end of the slot toward the transport shaft such that movement of the transport shaft along the first axis is restricted; and a spring biasing the adjusting plate toward a platen along the first axis, wherein the spring is coupled to the adjusting plate.

14. The apparatus of claim 13, wherein the tightening of the adjustment pin biases the tapered end of the slot toward the transport shaft such that the movement of the transport shaft along the first axis is prevented.

15. The apparatus of claim 13, wherein the adjustment pin is a screw.

16. The apparatus of claim 13, wherein the slot is a trapezoidal hole.

17. A method for adjusting a gap in a printer, comprising:

moving an adjusting plate along a first axis, wherein the adjusting plate is coupled to a print head via a transport shaft, wherein the first axis is perpendicular to the transport shaft, wherein the print head is slidably coupled to the transport shaft, wherein the adjusting plate comprises a groove, wherein the adjusting plate is slidably coupled to the transport shaft via the groove, wherein the moving causes a movement of the print head into a position to form the gap between the print head and a platen: and coupling the adjusting plate to a printer frame via an anchoring pin such that a further movement of the print head is prevented.

18. The method of claim 17, further comprising:

biasing an end of the groove toward the transport shaft using a spring, wherein the spring is coupled to the adjusting plate, and wherein the spring rotationally biases the adjusting plate around an axis defined by the anchoring pin.

19. The method of claim 17, further comprising:

inserting a gage shim between the platen and the print head; and coupling the adjusting plate to a printer frame when the print head presses against the gage shim such that the gap is defined by the gage shim.

20. An apparatus comprising:

a support member, wherein the support member is coupled to a gap defining member, wherein the gap is defined by a position of the gap defining member;

an adjusting plate having a groove, wherein the adjusting plate is slidably coupled to the support member via the groove, and wherein moving the adjusting plate changes the position of the gap defining member to form the gap; and a flexible band biasing the adjusting plate such that an end of the groove is biased toward the support member, and wherein the flexible band biases the adjusting plate towards the gap an anchoring point, wherein the flexible band rotationally biases the adjusting plate around an axis defined by the anchoring point such that the groove is biased toward the support member.

* * * * *